US010065053B2

(12) United States Patent
Verstegen et al.

(10) Patent No.: US 10,065,053 B2
(45) Date of Patent: Sep. 4, 2018

(54) DEVICE FOR EVACUATING INDIVIDUALS

(71) Applicant: Evacuator International Property B.V., Uden (NL)

(72) Inventors: Eugene Gijsbertus Maria Verstegen, Uden (NL); Joris Veeger, Zeeland (NL)

(73) Assignee: Evacuator International Property B.V., Uden (NL)

( * ) Notice: Subject to any disclaimer, the term of this patent is extended or adjusted under 35 U.S.C. 154(b) by 202 days.

(21) Appl. No.: 14/910,309

(22) PCT Filed: Jul. 17, 2014

(86) PCT No.: PCT/NL2014/050487
§ 371 (c)(1),
(2) Date: Feb. 5, 2016

(87) PCT Pub. No.: WO2015/020517
PCT Pub. Date: Feb. 12, 2015

(65) Prior Publication Data

US 2016/0175622 A1 Jun. 23, 2016

(30) Foreign Application Priority Data

Aug. 5, 2013 (NL) ..... 2011266
Nov. 7, 2013 (NL) ..... 2011756

(51) Int. Cl.
*A62B 1/08* (2006.01)
*A62B 1/10* (2006.01)
(Continued)

(52) U.S. Cl.
CPC ..... *A62B 1/08* (2013.01); *A62B 1/10* (2013.01); *A62B 1/16* (2013.01); *A62B 1/18* (2013.01)

(58) Field of Classification Search
CPC ... B66D 1/26; B66D 1/54; B66D 5/04; B66D 5/20
See application file for complete search history.

(56) References Cited

U.S. PATENT DOCUMENTS 184,978 A 12/1876 Neville
260,422 A * 7/1882 Rohmer ..... A62B 1/10 182/236

(Continued)

FOREIGN PATENT DOCUMENTS

EP 2609963 A1 7/2013
GB 2451499 A1 2/2009
WO WO 2012/025932 A1 3/2012

OTHER PUBLICATIONS

International Search Report issued in co-pending International Patent Application No. PCT/NL2014/050487 dated Nov. 5, 2014, European Patent Office, 8 pages.

(Continued)

*Primary Examiner* — Emmanuel Monsayac Marcelo
(74) *Attorney, Agent, or Firm* — McDonnell Boehnen Hulbert & Berghoff LLP

(57) ABSTRACT

The present disclosure relates to a device for evacuating individuals from a structure during an emergency, comprising: a rotatable drum with a cable suitable length, wound thereon; and a rotation regulator, which is associated with the drum and is arranged to control the drum to limit a rotation speed thereof during unwinding of the cable from the drum. The rotation regulator allows for individuals to escape from a tall structure, regardless of their skill, agility or strength, and even irrespective of whether such individuals are conscious, or not. In an embodiment the device may further comprise at least one additional drum. The combination of the drum and the additional drum allows a plurality of people to escape.

17 Claims, 11 Drawing Sheets

(51) Int. Cl.
*A62B 1/16* (2006.01)
*A62B 1/18* (2006.01)

(56) References Cited

U.S. PATENT DOCUMENTS

| | | | | | |
|---|---|---|---|---|---|
| 422,159 | A | | 2/1890 | Rose | |
| 425,554 | A | | 4/1890 | Stiver et al. | |
| 493,490 | A | | 3/1893 | Felt | |
| 631,382 | A | | 8/1899 | Rees | |
| 701,094 | A | | 5/1902 | Setbacken et al. | |
| 1,308,480 | A | | 7/1919 | Caouette | |
| 1,333,530 | A | | 3/1920 | Atamian | |
| 1,500,943 | A | | 7/1924 | Jolkovski | |
| 1,593,704 | A | | 7/1926 | Morris | |
| 2,122,315 | A | | 6/1938 | Fosty et al. | |
| 2,518,934 | A | | 8/1950 | Renner et al. | |
| 2,526,065 | A | | 10/1950 | Chodacki et al. | |
| 2,544,729 | A | | 3/1951 | Schauer | |
| 2,665,111 | A | | 1/1954 | Sokolik | |
| 2,896,912 | A | | 7/1959 | Faugier et al. | |
| 3,158,355 | A | * | 11/1964 | Wilson | B66D 1/26 254/214 |
| 3,188,052 | A | | 6/1965 | Longworth | |
| 3,587,474 | A | | 6/1971 | Fuchs | |
| 3,879,016 | A | | 4/1975 | Kankkunen | |
| 3,907,256 | A | | 9/1975 | Kankkunen | |
| 3,915,432 | A | | 10/1975 | Bustamante | |
| 3,946,989 | A | | 3/1976 | Tsuda | |
| 4,177,962 | A | | 12/1979 | Hildebrandt | |
| 4,416,430 | A | * | 11/1983 | Totten | A62B 1/10 182/237 |
| 4,432,437 | A | | 2/1984 | McClung | |
| 4,448,284 | A | | 5/1984 | Ciabo | |
| 4,457,400 | A | | 7/1984 | Donaldson et al. | |
| 4,458,781 | A | | 7/1984 | Ellis et al. | |
| 4,469,196 | A | | 9/1984 | Sadler | |
| 4,567,963 | A | | 2/1986 | Sugimoto | |
| 4,602,699 | A | * | 7/1986 | Matt | A62B 1/10 182/234 |
| 4,611,688 | A | | 9/1986 | Sekhar | |
| 4,623,038 | A | | 11/1986 | Stancato | |
| 4,653,609 | A | | 3/1987 | Devine | |
| 4,941,549 | A | | 7/1990 | Da-Tan et al. | |
| 5,052,523 | A | | 10/1991 | Ericson | |
| 5,060,758 | A | | 10/1991 | Ishioka | |
| 5,094,405 | A | | 3/1992 | Brum | |
| 5,351,906 | A | | 10/1994 | Feathers | |
| 5,570,854 | A | | 11/1996 | Brum et al. | |
| 5,836,535 | A | | 11/1998 | Brum | |
| 6,279,682 | B1 | | 8/2001 | Feathers | |
| 6,793,038 | B2 | | 9/2004 | Meller | |
| 7,281,620 | B2 | | 10/2007 | Wolner et al. | |
| 2002/0179372 | A1 | | 12/2002 | Schreiber et al. | |
| 2004/0055824 | A1 | | 3/2004 | Karnes et al. | |
| 2005/0023085 | A1 | | 2/2005 | Munton | |
| 2005/0189177 | A1 | | 9/2005 | Byrne | |
| 2007/0235254 | A1 | | 10/2007 | Soucek | |
| 2008/0314685 | A1 | * | 12/2008 | Verstegen | A62B 1/10 182/231 |
| 2010/0282541 | A1 | * | 11/2010 | Renton | A62B 1/18 182/234 |
| 2011/0088976 | A1 | | 4/2011 | Jones et al. | |
| 2011/0100755 | A1 | | 5/2011 | Meillet et al. | |
| 2013/0206510 | A1 | | 8/2013 | Casebolt | |
| 2014/0318896 | A1 | | 10/2014 | Larsson et al. | |

OTHER PUBLICATIONS

International Preliminary Report on Patentability issued in co-pending International Patent Application No. PCT/NL2014/050487 dated Aug. 14, 2015, 6 pages.
Decision on Appeal issued in U.S. Appl. No. 12/097,075, mailed on Aug. 29, 2017, 10 pages.

* cited by examiner

DEVICE FOR EVACUATING INDIVIDUALS

This application is a National Stage Application of International Patent Application No. PCT/NL2014/050487, filed Jul. 17, 2014, which claims the benefit of, and priority to, Netherlands Patent Application No. 2011266, filed Aug. 5, 2013, and Netherlands Patent Application No. 2011756, filed Nov. 7, 2013, the contents of these applications being incorporated entirely herein by reference.

The present invention relates to devices for evacuating individuals during an emergency from a structure, such as a tall structure. Specifically, the present invention relates to devices for safely lowering more than one individual, preferably irrespective of the weight of the individual, for instance during a fire from one of the higher floor levels of the tall structure, down to the ground level, more in particular at a lower than a predetermined maximum speed.

During emergencies such as fires, it becomes often necessary to rapidly evacuate persons from the affected structure such as a high-rise building. This can become difficult, dangerous and even impossible if access to the internal fire escapes is blocked; for example, by flames and/or smoke.

In such cases, the only available escape route may be along the exterior of the building, but ordinarily that route is, under the best of circumstances, available only to occupants of lower floors of the structure.

While floors at intermediate heights of the structure could be evacuated via ladders, provided that ladders are provided or arrive in time with or on fire trucks, occupants of the higher floors are in greater danger, unless the fire can be controlled in time before it reaches and/or spreads throughout such floors.

Prior art attempts have been made to provide occupants of high rise structures with a way to escape along the exterior of the building during emergencies.

U.S. Pat. No. 260,422 discloses a fire escape device, comprising one or more drums for wire cables, which, being carried over pulleys, have attached to their free extremities cages, of which each cage is of capacity sufficient to hold one or more persons. In order to regulate and place under control the rapidity of descent of the loaded cages, an adjustable brake or governor is provided.

Typically, such prior art attempts involved providing a rope or cable that is suitably anchored to the building, which can be lowered alongside the building to hang from a higher floor of the tall structure, and a mechanism frictionally engaging the rope and adapted to suspend the escaping person therefrom, and means operable by the escaping person for controlling friction to thereby lower himself at a controlled, sufficiently low speed to prevent injury upon the person's arrival on the ground. Such prior art attempts were based on principles comparable with the technique of "abseiling".

However, these attempts exhibit a common number of drawbacks, including their reliance on power from or strength of the person descending to slow down his or her rate of descent and the need for some skill on the part of the descending person to properly operate such devices, and especially the descent rate lowering parts thereof. Even in case that an individual to be evacuated is physically strong enough to slow down an excessive rate of decent and has sufficient skill to operate such a prior art device, the mere circumstances during an emergency, like for example panic and confusion, will make it difficult for such individual to safely reach ground level, if not properly trained.

From operational and safety points of view, it is therefore preferred if tall structures could be equipped with escape devices which, on demand, automatically lower a person at a safe, controlled speed, preferably independent of the weight of the individual, along the exterior of buildings without relying on the strength, dexterity, skill injury or even consciousness of the person being lowered.

Further, such device should be able to resist high temperatures, should be reliable and hence have a relatively simple but rather construction, and should be easy to use even under difficult circumstances, and/or even be suitable to lower unconscious individuals.

Such objectives as indicated above, and/or other benefits or inventive effects, are attained according to the present disclosure by the assembly of features in the appended independent device claim and in the appended independent method claim.

According to the present invention, a tall structure can be any structure such as a multi-story office building, a skyscraper, an oil platform or a chemical plant, comprising higher floor levels which are difficult or impossible to reach from the exterior using for example ladders during an emergency such as a fire.

According to the present invention, the size of the drum is determined by the length of the cable to be wound about the drum.

If, for example, the device according to the present invention is used in a multi-story office building comprising ten floors with a total height of approximately forty meters and the device is fixed to the building on the tenth floor, then a cable of approximately forty meters is necessary to safely lowering the occupants of the tenth floor to the ground level of the building.

Hence the size of the drum should be sufficient to accommodate at least approximately forty meters of cable wound about it in order to reach ground level.

In the above situation, if the device is fixed to the eighth floor, then the drum should be capable of at least accommodating a cable of approximately thirty two meters to reach ground level. Thus, the minimal requirement for the size of the drum is, amongst others, determined by the length of the cable wound about it, which cable length in turn is at least determined by the height of the floor to be evacuated above a safe level, such as a ground level.

Such safe level is not necessary ground level since it can be envisaged that individuals to be saved can be lowered to a level above ground level and from this level use other emergency escape means such as emergency stairs, a fire truck ladder or an elevator to evacuate the building.

Because of this, the phrase "a cable of sufficient length" refers to a minimal cable length necessary to reach a safe or safer floor level allowing the individual to evacuate the tall structure. According to the present invention, the rotation regulating means for controlling the rotation speed allow for regulating the maximal rotation speed of the drum and hence the descending speed of the individual to be saved, regardless of this individual being injured, unconscious, or even merely scared.

Since, the rotation speed of the drum is restricted by the rotation regulating means to a maximal rotation speed, the rate of descent of the individual to be saved is not determined by his weight, which determines only the gravitational acceleration of the descent. This means that compared to a person having less weight, the maximal rotation speed is only achieved sooner during the descent, because of the higher acceleration, but a relevant descent speed, determined by the prefixed maximal rotation speed of the drum, will not become any higher.

The device comprises at least one additional drum. Thereby it is made possible to lower more than one individual at a time or subsequently, before having to retract at least one cable associated each with one of the drum and/or the additional drum.

The device further exhibits a selector or a switch arranged to selectively connect at least one of the drum and the additional drum with the rotation regulator. Such a switch or regulator may be used to determine which one of the drum and the additional drum is used at one time for lowering an individual, or a plurality of individuals simultaneously. Such a switch or selector can be formed in many different ways, for instance an active switch to be set by an operator, or a passive switch or selector, which may be responsive to weight suspended from a cable, corresponding with the weight of an individual to be lowered.

In yet a further embodiment, the device may comprise a transmission, which is provided between at least the drum and the rotation regulator and is arranged to selectively connect at least the drum with the rotation regulator. Such a transmission can be usefully employed to increase the rotational speed of a relevant one of the drum and the additional drum, if provided, and thereby enhance effectiveness of the rotation regulator. When the rotation regulator is subjected to a higher rotational speed, the effectiveness thereof is most likely to be enhanced.

In an embodiment having a switch or selector and a transmission, the transmission may comprise the switch or selector, or vice versa. In this manner even integration of the switch or selector into the transmission or integration of the transmission into the switch or selector is viable. Thereby, numbers of components can be reduced to yield an elegant and simple design.

In yet another embodiment, the device may exhibit the feature, that at least the drum is accommodated on a transmission axis. If provided, also the additional drum may be accommodated on the same transmission axis or a separate transmission axis. The transmission axis may comprise or accommodate a switch or selector to allow active or passive setting when each of the drum and, if provided, the additional drum is actually coupled to the transmission axis. In case of separate transmission axes for the drum and, if provided, the additional drum, independent control over which of the drum and the additional drum is braked is possible. The drum and, if provided, the additional drum can be associated with, if not coupled to, a singular rotation regulator or separate rotation regulators. In such an embodiment, with the device having a transmission axis to accommodate at least the drum, wherein the transmission axis may be rotatable within at least the drum, an comprises an assembly of an extendable arm and a recess, wherein the recess is shaped and designed to accommodate the arm in a predetermined rotational position of the transmission axis relative to the drum. Thereby, a more passive switch or selector can be embodied, where the extendable arm can turn or swivel to extend toward the recess, to be engaged thereby at the predetermined rotational position and link or couple the transmission axis and at least the drum. In such an embodiment, the arm may be accommodated in or on the axis and the recess is arranged in the drum, or vice versa. In any case, a coupling between the drum and the transmission axis can be realized, to be activated when the drum is rotated in a predetermined orientation.

In yet another embodiment with the drum arranged on the transmission axis, the device may exhibit the feature that the transmission axis is connected to the rotation regulator, preferably via transmission, which transmission is arranged to increase the rotational speed of the axis for the rotation regulator. Consequently, the transmission axis is interposed between the drum and the rotation regulator in conjunction with the transmission to increase the rotational speed of an axis on which the rotation regulator acts, to be able to limit the rotational speed of the drum in combination with the rotational speed of the axis on which the rotation regulator acts.

In yet another embodiment a guide sleeve in use to be arranged on the cable is arranged at a fixed distance from the device. Such an guide sleeve is intended to protect the cable itself, when being unwound over an edge, like an edge of a balcony, where friction may cause damage to the cable, especially when the cable is repeatedly used for lowering individuals from the tall structure. In an embodiment having such a guide sleeve, the device preferably exhibits the feature that the guide sleeve is attached to a flexible retainer. Such a flexible retainer allows the guide sleeve to be repositioned or moved, also when any individual is suspended from the cable and subject to a swinging movement. In such an embodiment the guide sleeve effectively continues to perform its function of protecting the cable.

In yet another embodiment, the device may exhibit the feature that the rotation regulator comprises a swivel brake shoe, which is connected or connectable to at least the drum to rotate at a rotational speed corresponding with that of the drum during unwinding of the cable, and arranged to swivel relative to a rest position, when rotational speed of the drum approaches and/or exceeds a predetermined threshold. In the defined rest position the brake shoe is inactive, and can be swiveled into an extended, outward oriented position to contact or engage a brake surface and thus brake a rotational speed of the drum.

To achieve such predetermined maximal rotation speed of the drum, the rotation regulation means may comprise a first member encasing an expandable second member rotatable in said first member, wherein the expansion of said second member is controlled by the rotation speed of said drum. According to the present invention, the rotation of the drum initiated by an individual engaging the device according to the present invention during an emergency is translated on the second member causing it to start rotating within the first member. Said rotation of the second member will cause a centrifugal force on the second member causing it to expand in the direction of the inner surface of the first member.

Because the centrifugal force is directly related to the rotation speed of the drum, the higher the rotation speed of the drum, the larger the centrifugal force on the second member will be. Because there is also a positive correlation between the centrifugal force on the second member and the expansion of the second member, at a predetermined rotation speed of the drum, the expansion of the second member will become large enough to frictionally engage the inner surface of the first member.

This frictional engagement of the second member with the first member will prevent a further increase in rotation speed of the second member and thereby the rotation speed of the drum, limiting the descending speed of the individual engaging the device according to the present invention.

In an embodiment comprising the brake shoe, the swivel brake shoe may comprise a flexible restrainer, arranged to restrain the swivel brake shoe from swiveling at a rotation speed of the drum below the predetermined threshold of the rotational speed of the drum. Such a flexible restrainer can serve to keep the brake shoe in the rest position as long as possible, until a rotational speed is developed, which approaches or exceeds the threshold value to start breaking the individual's descent.

According to a preferred embodiment of the present invention, the first member has a cylindrical form, thereby providing a maximal inner surface area of the first member capable of frictionally engaging the expandable second member. This allows for an optimal counter force for the centrifugal force of the second member, thereby, amongst others, minimalizing the size and weight of the rotation regulating means.

According to a more preferred embodiment of the present invention, also the second member has a cylindrical form to further maximalize the frictional engagement with the first member.

According to one preferred aspect of the present invention, the second member of the means for controlling the rotation speed of the drum comprises two or more break shoes connected by a spring mechanism to a rotational axis of the rotational regulator or to each other in an at least approximately symmetrical manner. In such an embodiment, a balanced action of a plurality of brake shoes can be established and maintained.

Upon sufficient expansion of the second member, the two or more brake shoes engage the inner surface of the first member thereby providing the counter force necessary to prevent further expansion of the second member due to the centrifugal force.

On the other hand, the spring mechanism connecting the two or more brake shoes, determines the rate of expansion of the second member in response to the centrifugal force created by the rotation speed of the drum.

Specifically, the stronger the spring force of the spring mechanism connecting the two or more break shoes, the higher centrifugal force, and hence rotation speed of the drum, is necessary before the second member frictionally engages the inner surface of the first member.

In other words, the spring force counteracts the centrifugal force thereby allowing to easily predetermine the maximal rotation speed of the drum by adjusting the strength of the springs employed. Usually, a rotation speed of the drum is predetermined to allow a descending speed of the individual to be saved of 2 to 20 km/h, preferably, 5 to 15 km/h, more preferably 5 to 10 km/h by adjusting the counter force provided by the spring mechanism. In a particularly preferred embodiment, the drum and cable are embodied in metal. Embodying these components of the device according to the present invention in metal provide maximal resistance to, for example, high temperatures caused by a fire.

In addition, embodying the cable in metal allows for a reduction of the weight of the cable which is determined by both the necessary length of the cable for reaching a safe floor level and the weight of the individual it should be able carry without breaking. Metal provides, using relatively thin cables, a considerable weight reduction and loading capacity. Because of the resistance of metal to fire, also the regulating means for controlling the rotation speed are preferably embodied in metal. However, it can be envisaged that certain specific parts of the rotation speed regulation means are not embodied in metal such as for example the breaking shoes of the second member.

To facilitate attachment of the device according to the present invention to a tall structure, the device preferably comprises an attachment to fix the device to the tall structure such as a framework encasing the device according to the present invention.

Preferably, the device according to the present invention further comprises means for attachment of the individual to the end of the cable. Such means can for example be a hook, a harness, a seat, a cage, a loop, and a handle.

In one other preferred embodiment, the device according to the present invention comprises means, such as a handle or a motor, for rewinding the cable about the drum after the device has been used to evacuate one individual. This embodiment allows for the evacuation of multiple individuals using a single device.

In yet another embodiment, the device may comprise a crank mechanism for winding the cable about the drum. Alternatively, a motor can be provided, on the condition that an independent power supply is furnished in combination there with. Especially in case of fire, a power supply from the mains power grid can be disconnected, and consequently, a battery or the like may be preferred to power such a motor. Even in case of a mechanical crank mechanism, the objective is to allow an operator or other individual to retract or withdraw the cable after having lowered another individual down to a safe level and thereby make the device available for lowering yet another individual to the safe level.

The device according to the present invention provides on demand, automatically lowering of a person at a safe, controlled speed, independent of the weight of the individual, along the exterior of buildings without relying on the strength, dexterity, skill or consciousness of the person being lowered. Further, the device according to the present invention is resistant to high temperatures, is reliable resistant easy to use even under difficult circumstances.

Therefore, the present invention also relates to a method for safely evacuating an individual during an emergency from a tall structure comprising attachment of the individual to the device according to the present invention and lowering the individual to the ground level using the device.

Additionally, the present disclosure encompasses a method for safely evacuating individuals from a tall structure during an emergency comprising:

(a) attaching at least one first individual to a device of any preceding claim;

(b) lowering the at least one first individual to a safe level using the device;

(c) rewinding the cable about the drum;

(d) optionally, repeating steps (b) to (c).

Optionally, the method may comprise the step of subsequent or simultaneous lowering of more than one of the individuals prior to rewinding at least one cable.

After the above more general realistic indication of embodiments of the present invention, more detailed realisations into practice will be further described herein below under reference to illustrations in the appended drawing, wherein the same or similar reference numbers may be used for the same, similar or comparable elements, components and aspects, and wherein the below described embodiments merely serve to enhance the readers understanding of the general and detailed principles of the invention, without limitation to the specifically illustrated embodiments or components, elements and/or aspects thereof, and wherein:

Figures 1, 2:
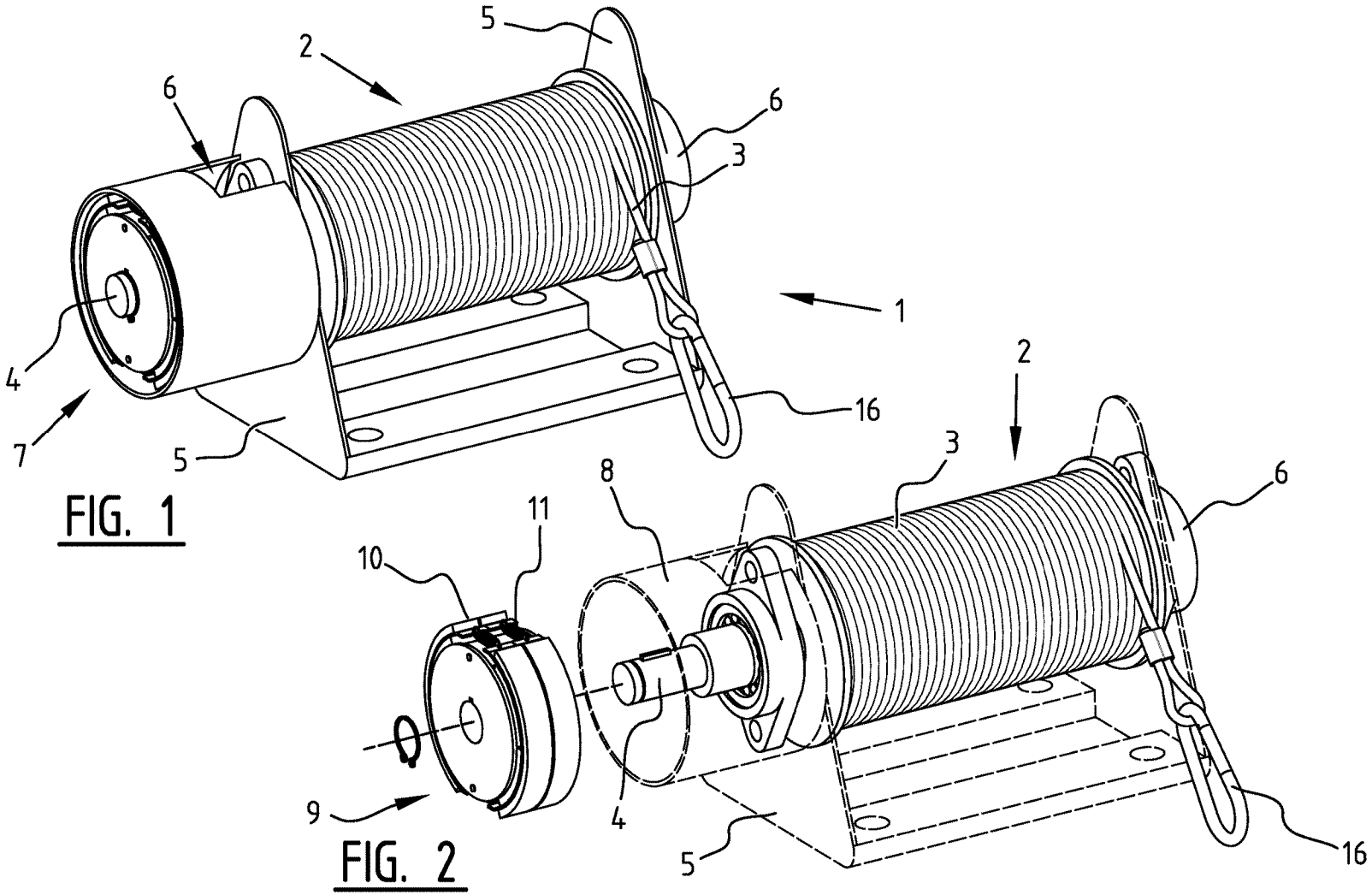
FIG. 1 represents a view in perspective of a device according to the present invention.
FIG. 2 represents an exploded view of the device shown in FIG. 1.

FIG. 1 shows a safety device 1, comprising a drum 2 and a cable 3 of suitable length wound about said drum 2. The drum 2 is mounted on an axle 4 rotatable in a frame 5 using ball-bearings 6. The axle 4 transmits rotation of the drum 2 to rotation regulator 7 also mounted on frame 5.

Figure 5:
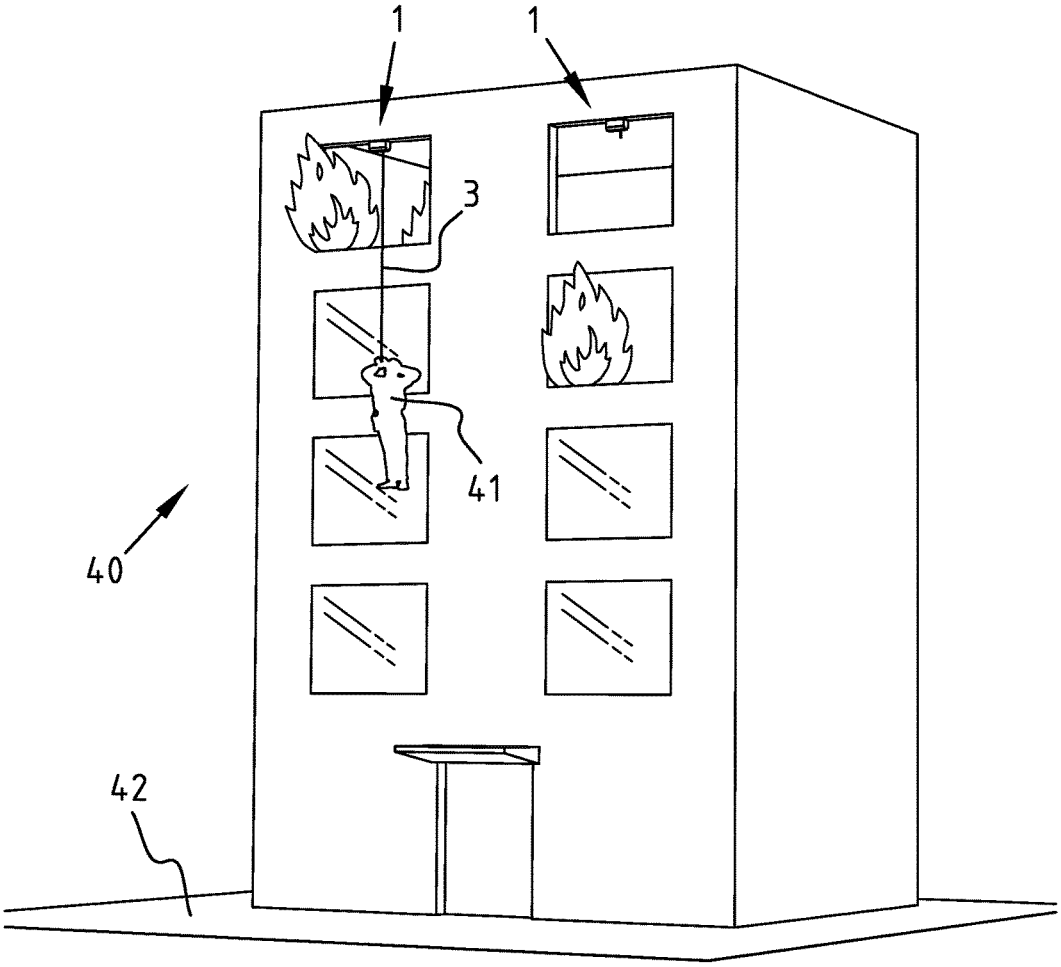
FIG. 5 represents a schematic drawing of an individual which is lowered from a tall structure using a device according to the present invention attached to the tall structure during a fire.

A hook fastener 16 connected to cable 3 allows coupling to the safety device 1 of an individual 41 in FIG. 5 to be saved from a building 40, and to be lowered to a ground level 42.

FIG. 2 shows the above described safety device, specifically detailing the rotation regulator 7. The rotation regulator 7 comprises a first substantially cylindrical member 8, encasing a second substantially cylindrical member 9. In the preferred embodiment shown, the second member 9 comprises brake shoes 10 connected to each other by a spring mechanism 11.

Upon rotation of axle 4, the second member 9 starts to rotate in the first member 8. This rotation will create a centrifugal force causing the second member 9 to expand when the brake shoes 10 elevate from the outer surface of the second member 9 under influence of centrifugal force at a determined rotational speed of the axle 4. As a result of the centrifugal force, the brake shoes 10 are forced against an inner surface of the first member 8.

Action of the brake shoes against the inner surface of the first member 8 is restricted by the springs 11. The centrifugal force, which is directly related to the rotational speed of the axle 4, must exceed the spring force of the springs 11 for the brake shoes 10 to act on the inner surface of the first member 8. In this manner control is provided over expansion of the second member 9, and action of the brake shoes 10 irrespective of the weight of an individual attached to a hook fastener 16 or the like, as depicted in FIG. 5.

This control allows setting of a rotational speed of the axle 4 and therewith of the drum 2, at which the two brake shoes 10 will frictionally engage the inner surface of the first member 8 to limit rotational speed of drum 2.

Figure 4:
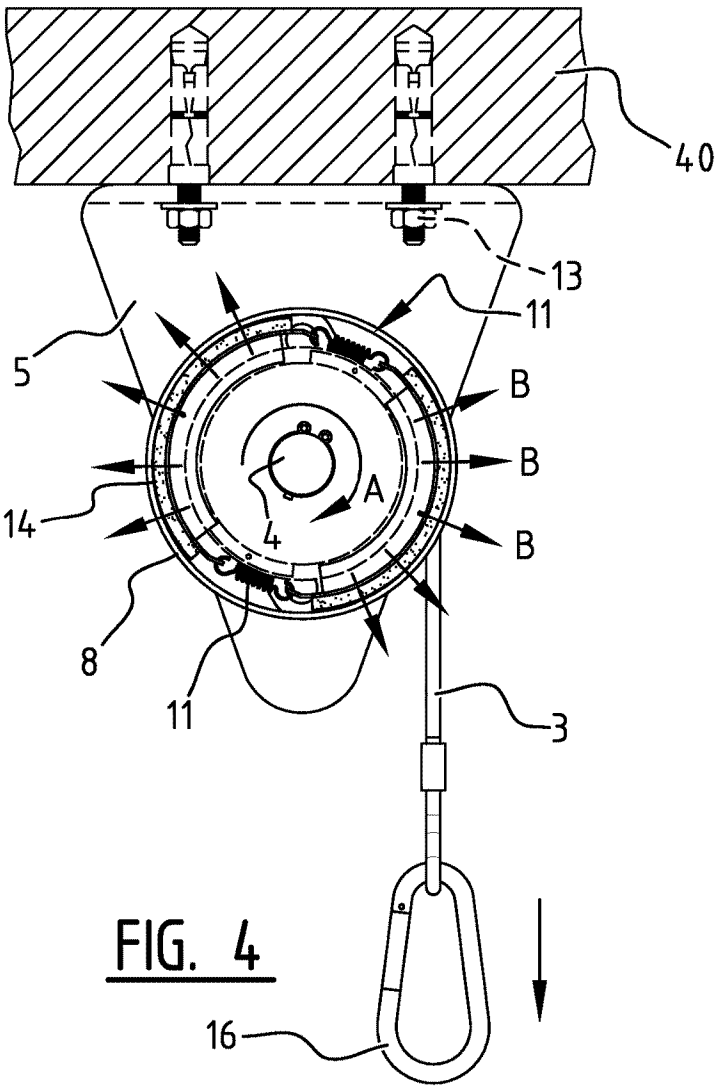
FIG. 4 represents a detailed view of the device shown in FIG. 1 in the inhibited rotation mode.
Figure 3:
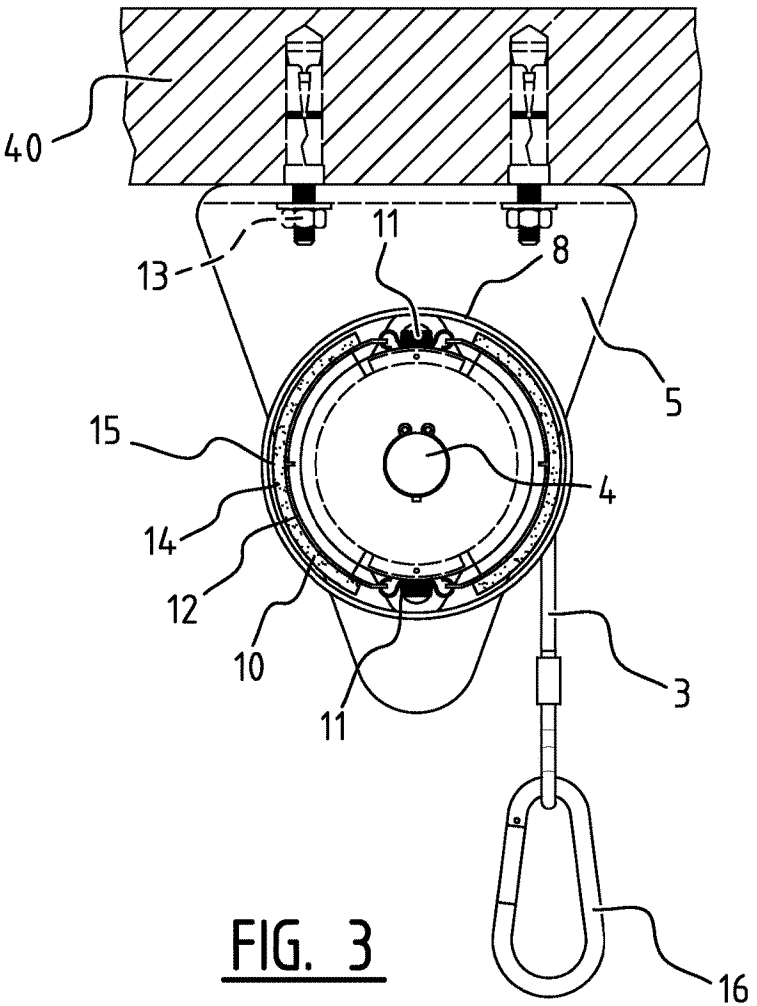
FIG. 3 represents a detailed view of the device shown in FIG. 1 in the free rotation mode.

A more detailed view of the brake shoes 10 and the spring mechanism 11 is provided in FIGS. 3 and 4.

FIGS. 3 and 4 show brake shoes 10 on second member 9, comprising a bracket 12 to provide assembly of spring mechanisms 11 and brake shoes 10 to surround the second member 9, and transmission of rotation of the axle 4 in the direction of arrow A on bracket 12 into a centrifugal force on the brake shoes 10. The outer surface of brackets 12 is at least partially covered by a frictional layer 14 for frictionally engaging the inner surface of the first member 8. When the axle 4, and hence the drum 2, is not rotating, and the device 1 is in rest or when axle 4 is rotating at a speed lower than a predetermined speed controlled by the spring mechanism 11 in relation to a generated centrifugal force in the direction of arrows B in FIG. 4, than a gap 15 between the first member 8 and the frictional layer 14 provides free rotation of the second member 9. However, at a predetermined rotation speed of the axle 4, as shown in FIG. 4, brake shoes 10 will elevate from the outer surface of the second member 9, when centrifugal force in the direction of arrows B in FIG. 4 exceeds a restraining force exerted on the brake shoes 10 by the springs 11. Then, the layer 14 will frictionally engage the inner surface of first member 8, thereby inhibiting a further increase of the rotation of the axle 4 and, as a consequence, also rotational speed of drum 2.

Frame 5 is attached to the tall structure 40 using bolt/nut connections 13.

The entire safety device 1 may be surrounded by an enclosure or housing comprising an opening to allow the cable 3 to pass through.

FIG. 4 shows the use of a safety device 1 during an emergency. The safety device 1 is firmly attached to the tall structure 40. The individual 41 to be rescued attaches himself or is attached by helpers to the cable 3 and is lowered, at a predetermined speed independent of the weight of the individual 41, and without active participation of the individual or any helpers. The safety device 1 automatically limits a lowering speed of the individual 41 along the exterior of the tall structure 40 to a safe level 42, which is ground level in the embodiment shown in FIG. 4.

Figure 6:
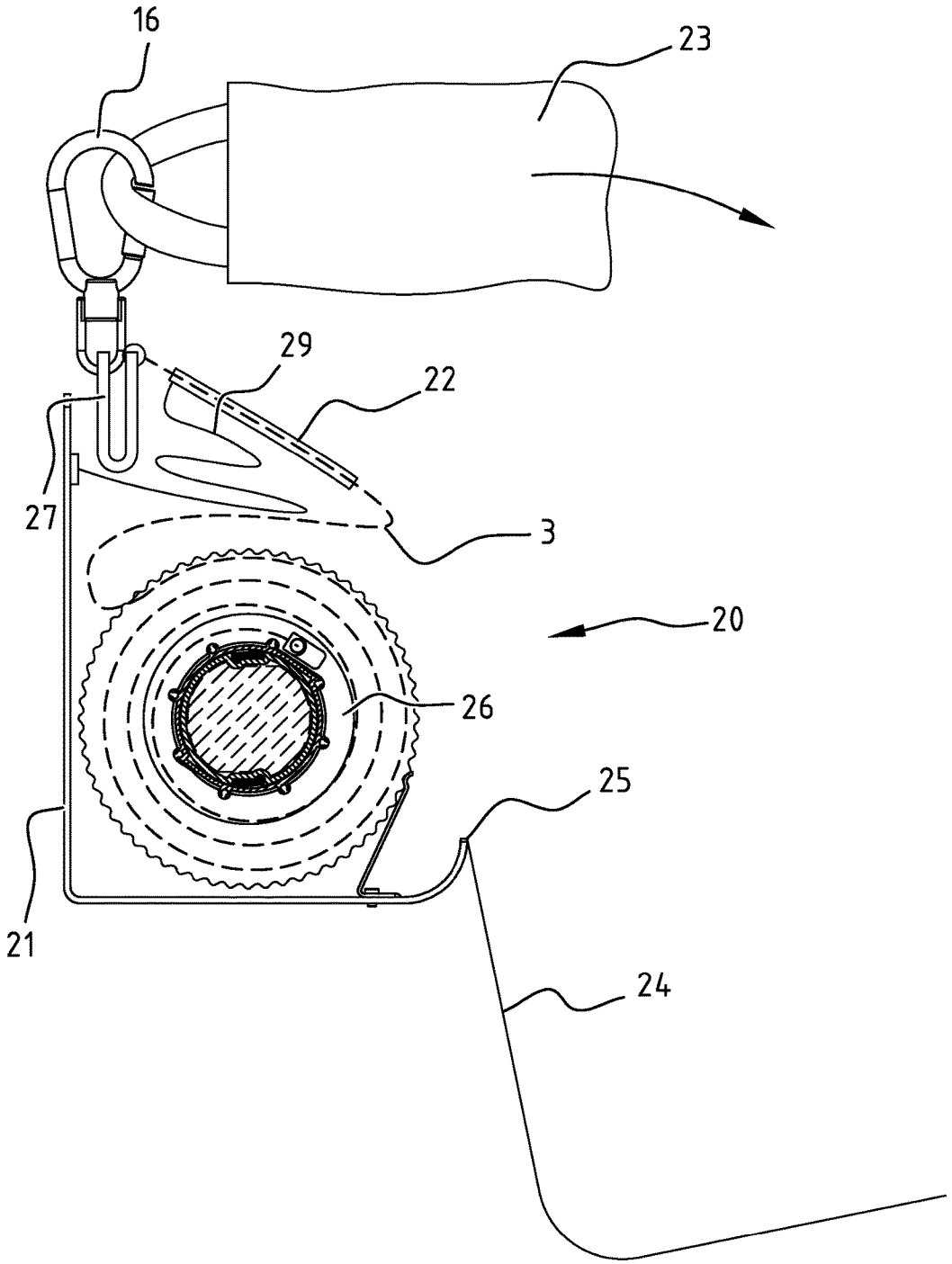
FIG. 6 represents a cross sectional side view of a device in another embodiment.

FIG. 6 shows a cross sectional side view of a further embodiment of a device 20 exhibiting particular principles or aspects of the present invention. Device 20 comprises a housing 21 with a lid 24 connected to housing 21 at a hinge 25. The housing 21 accommodates a drum 26 with cable 3 wound thereon. The cable 3 is connected to a hook fastener 16 or the like, via a shock absorber 27. Thus, when an individual attaches the hook fastener 26 to for instance a harness, which can be accommodated in a bag 23, after having put on the harness, and jumps from a tall building, it will take some time before the rotation regulator in a different embodiment relative to the previously described figures will start to act and limit rotational speed of the drum 26. Individuals, trying to escape from the tall building, may experience a shock or jolt, which may be damped by employing the shock absorber 27.

Additionally, the sleeve 22 is arranged around cable 3 near the hook fastener 16. This sleeve 22 is itself connected to the housing 21 of the device 20 via a chain 29 or another cable, or may be attached to a part or portion of the tall structure. When an individual, trying to escape from the tall structure, puts on the harness from the bag 23, attaches the harness to the hook fastener 16 and the jumps over a railing 28 of a balcony, or the like, cable 3 may experience considerable wear and tear from moving over an edge of the railing 28, especially in case of repeated use for lowering of individuals to safety. The sleeve 22 is then held at the specific distance from the device 20 or a part or portion of the tall structure by the chain 29 or additional cable. Preferably, the distance between an attachment point of chain 29 or cable and an edge of the railing 28 of a balcony is measured at installation of the device 20, where the same distance is set of the sleeve 22, such that the sleeve 22 rests on the railing 28 of the balcony or the like, as shown in FIG. 7.

Figure 7:
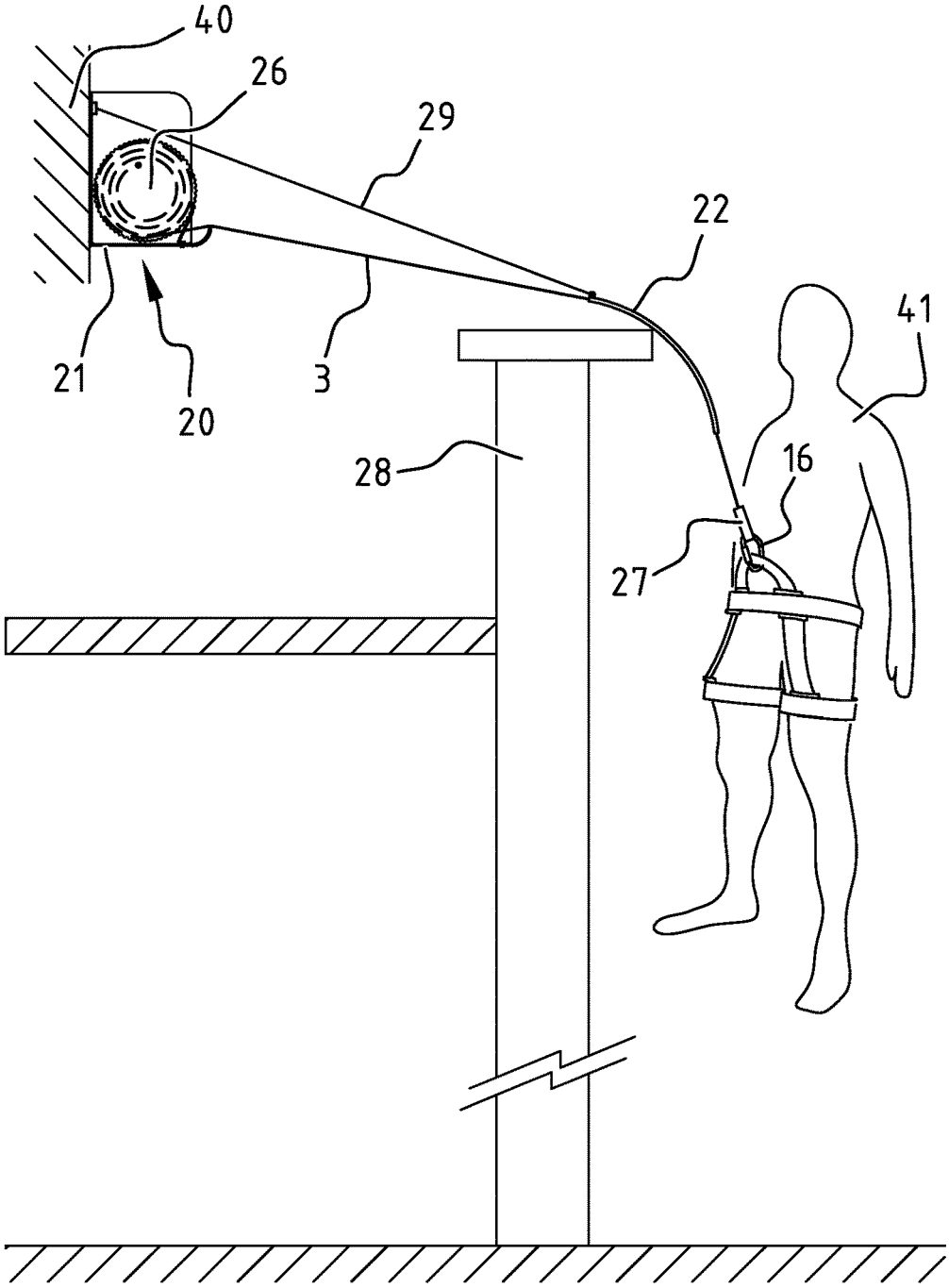
FIG. 7 represents a side view of the device according to FIG. 6 in use.

In FIG. 7, the device 20 is attached to a vertical wall of the tall structure 40. There, the lid 24 is omitted from the drawing. It is evident, that the chain 29 or cable is tensioned to keep the sleeve 22 in position over an edge of the railing 28 of the balcony of the tall structure 40. The cable, on the other hand, is free to unwind from the drum 26, and pass through the sleeve 22 in a protected state against wear and tear from the edge of the railing 28.

Figure 8:
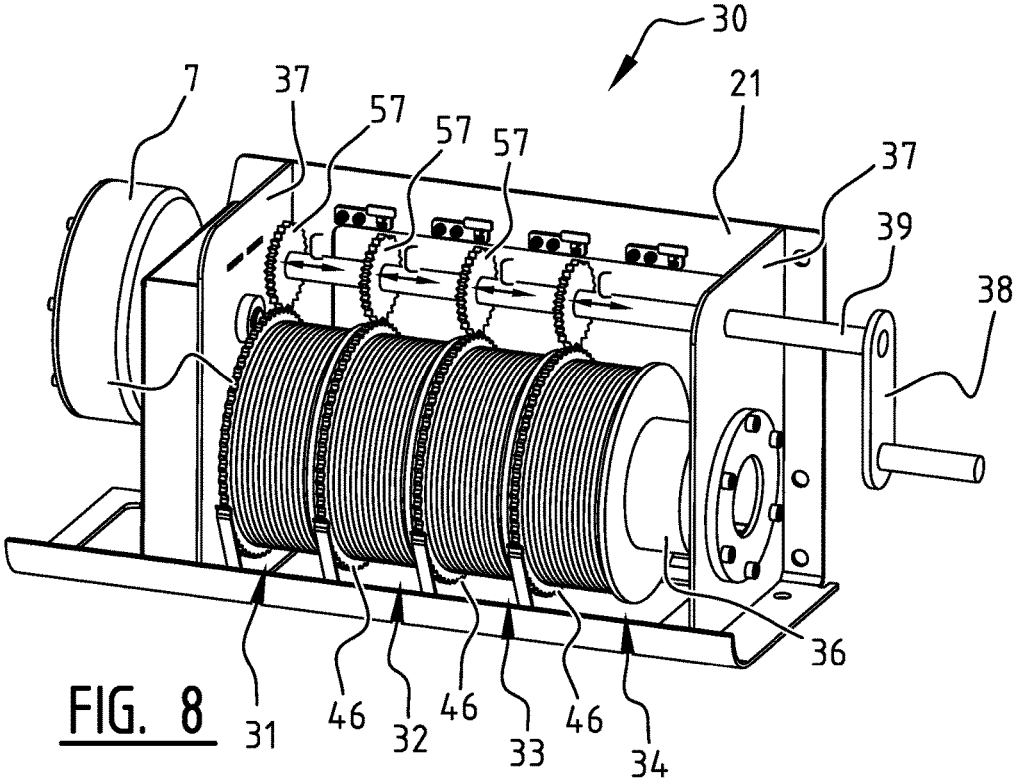
FIG. 8 represents in a perspective view an embodiment of a device in yet another embodiment.

FIG. 8 shows another embodiment of a device 30. The device 30 comprises a housing 21 accommodating a plurality of drums 31, 32, 33 and 34. The drums are arranged on a common transmission axis 35, or example shown in more detail in FIG. 10. The transmission axis 35 is suspended in bearings 36 between mounting plates 37. The mounting plates also accommodate a crankshaft 39 connected to a crank 38 for rewinding cable from a drum 31-34. Each of the drums 31-34 is capable of controlled lowering or unwinding of an associated cable 3. Each of the drums 31-34 has its own cable. Thereby it is possible to allow several individuals to descend without first having to rewind cable on the relevant one of drums 31-34. The embodiment of FIGS. 8, 9 and 10 even allows for simultaneous descent by multiple individuals, each or more than one of said individuals being coupled to a relevant one of the cables, where multiple cables may be employed simultaneously for a lowering one or more than one individual on each cable simultaneously or subsequently.

Figure 9:
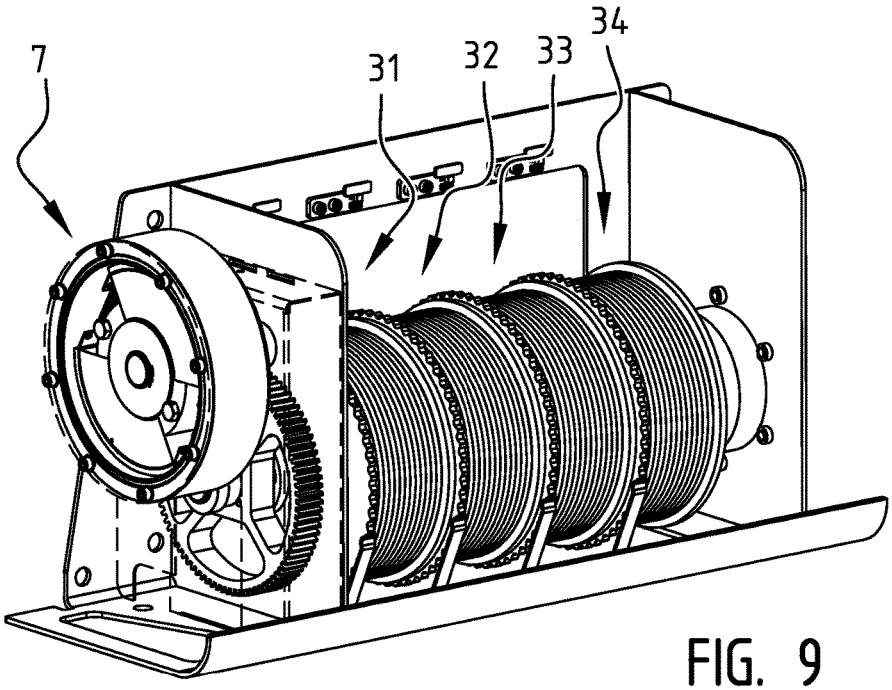
FIGS. 9 and 10 represent in respective perspective and exploded views an embodiment of a device in yet another embodiment.
Figure 10:
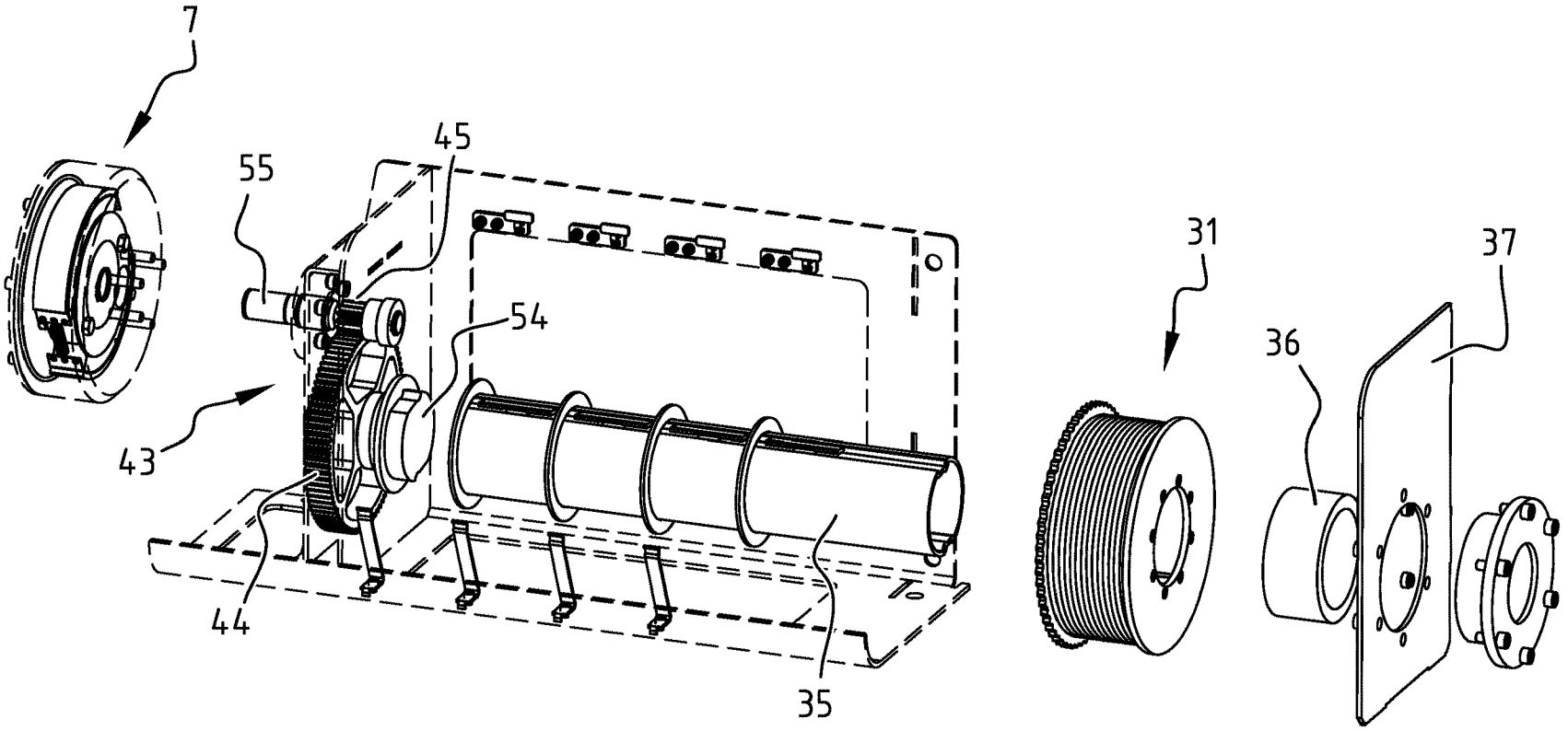

Also, this embodiment of FIGS. 8, 9 and 10 comprises a rotation regulator 7. The rotation regulator 7 is connected to transmission axis 35 via a transmission 43, which is made visible through the removal of the rotation regulator 7 in FIG. 10, representing an exploded view of the device of FIGS. 8 and 9, which is the same as the device in FIG. 9, except for the addition of the crankshaft 39 with the crank 38. The transmission 43 transforms a rotational speed of the transmission axis 35 into a higher rotational speed through the use of corresponding to the wheels 44, 45. Each one of the drums 31-34 in FIG. 8, 9 may be coupled with the transmission axis 35 at any particular time to allow individuals to descend from the tall structure. Only when individuals actually are suspended from a cable on a relevant one of the drums 31-34 is the drum coupled with the transmission axis 35. For this, a mechanism is employed, which will be described in more detail herein below. Likewise, each cable on the relevant one of the drums 31-35 can be retrieved after having been lowered, by using the crank shaft 39 in conjunction with the crank 38. At the side, each drum 31-34 comprises a toothed wheel, which can be selectively engaged by a corresponding to the wheel 57 on the crankshaft 39. Selectivity of such engagement can be achieved by movement of the toothed wheels 57 on the crankshaft 39 in the direction of double arrow C. To achieve such selectivity, the skilled person is able to devise any suitable configuration within the realm of his normal capability and capacity. When any one of the toothed wheels 57 is brought into engagement with the corresponding one of the toothed wheels 46, a cable can be rewound on its drum 31-34 by using the crank 38.

The rotational regulator 7 can be of the same type as the one described in relation to FIGS. 1 through 4, or may be any alternative type of configuration, which is preferably based on the rotational limitation of the speed of unwinding cables from the drums.

In the representation of FIG. 10, the transmission axis 35 is shown in isolation to have an elongate recess 58, in which coupling elements 47 are accommodated, the function and structure of which will be elaborated on in more detail herein below. Also, FIG. 10 shows one of the drums 31 in a disassembled state, comprising a flange 48, the cylindrical body 49 around which a cable 3 can be wound, and anchor ring 50 to fix the cable 3, and that the aforementioned tooth wheel 46. The cylindrical body 49 is enclosed between the flange 48 and the toothed wheel 46 with the anchor ring 50 on the essentially cylindrical body 49. The cylindrical body 49 comprises a number of projections 51, into which screws 52 can be driven to assemble the shown one of the drums 31. In an assembled state, drum 31 is arranged on the transmission axis 54.

Figure 11:
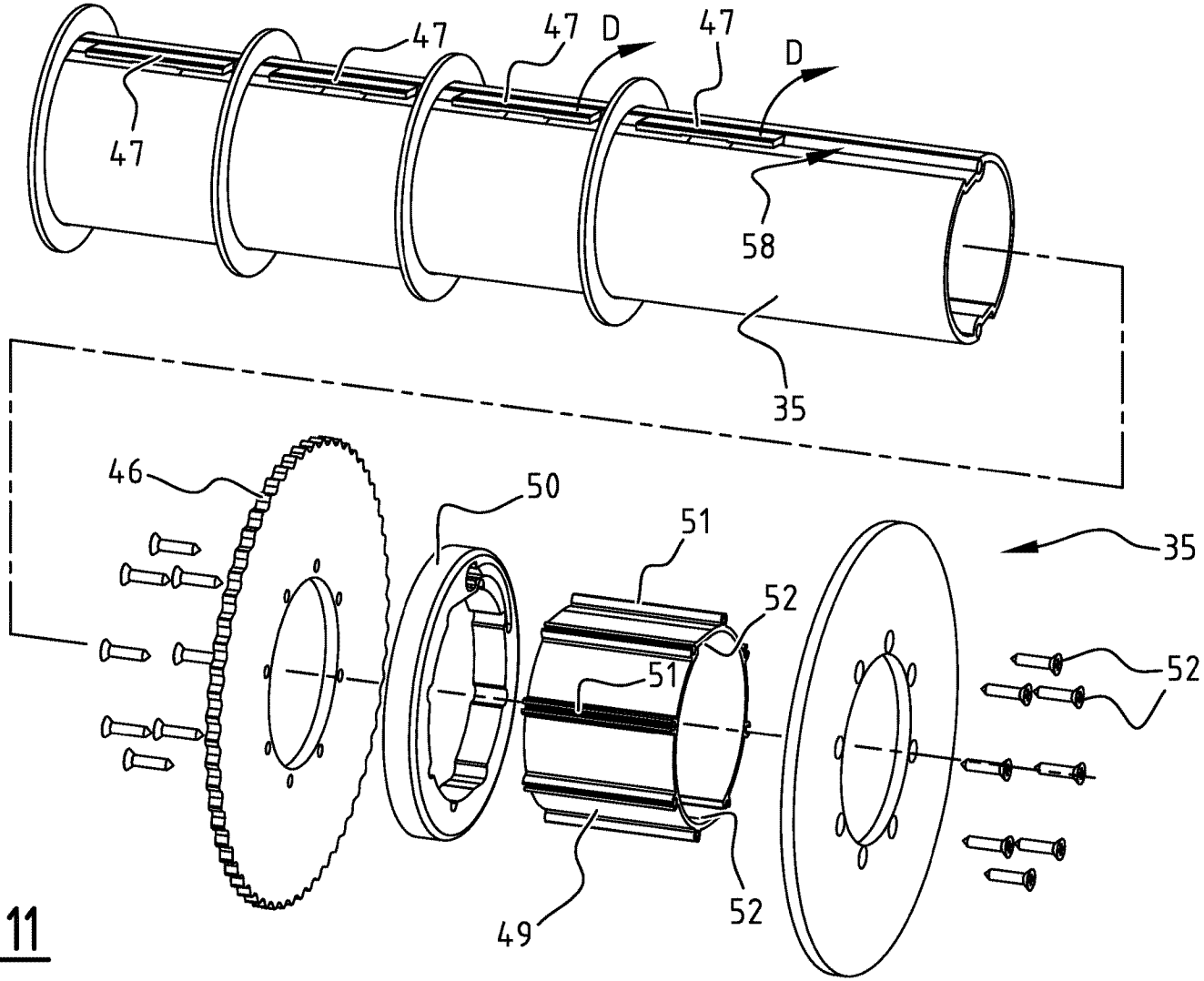
FIG. 11 represents a detail of the embodiment of FIG. 10.

The coupling elements 47 tend to rotate or swivel in the direction of arrows D in FIG. 11, but are constrained to stay within the recess 58 with the cylindrical body 49 on the transmission axis 35. The cylindrical body 49 further also comprises recesses 52, which or shapes and designs to fittingly accommodated coupling elements 47, when rotated in the direction of arrows D.

Figure 12:
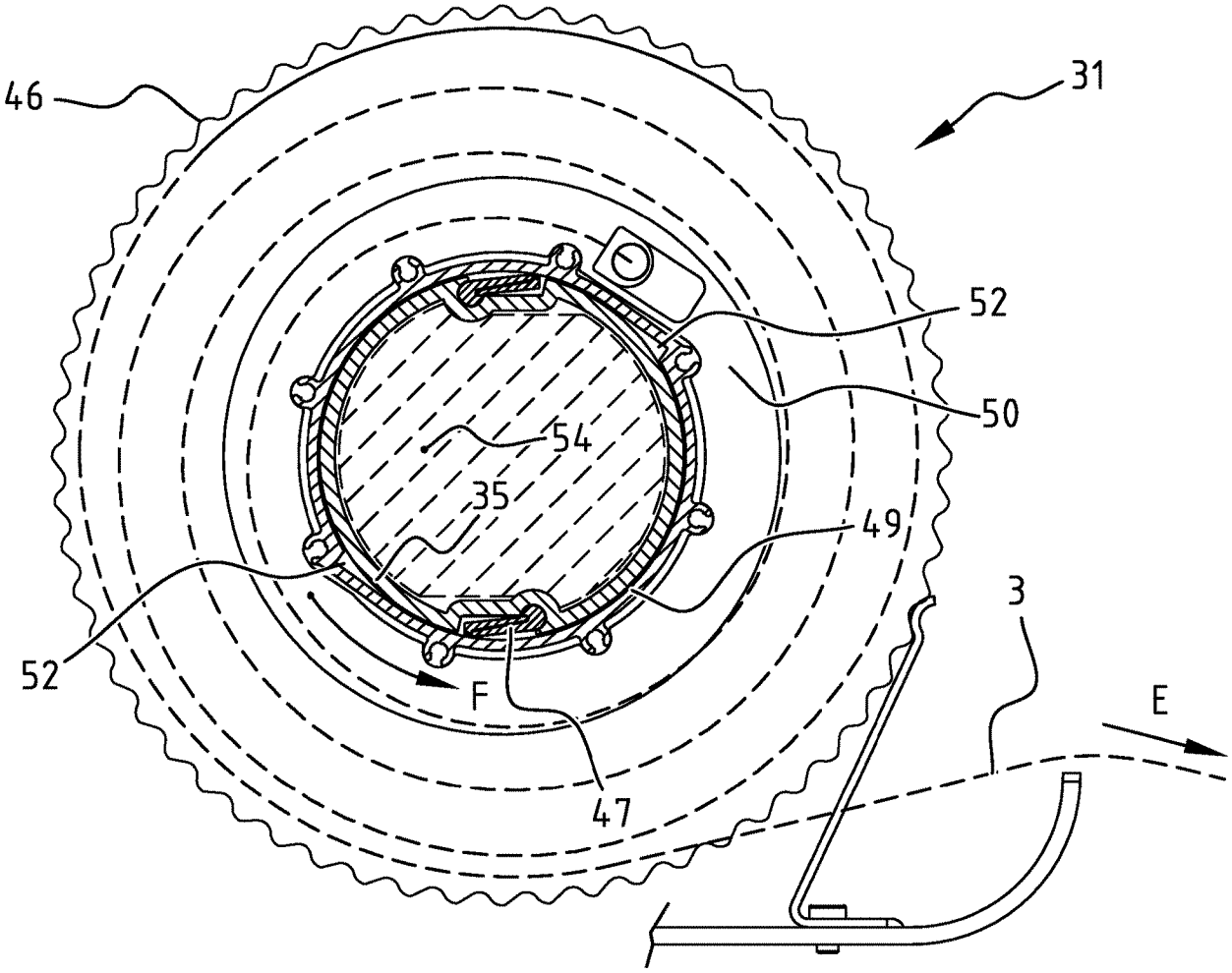
FIGS. 12 and 13 represent cross sectional side views of the embodiment in FIGS. 9-11 in one operational state.
Figure 13:
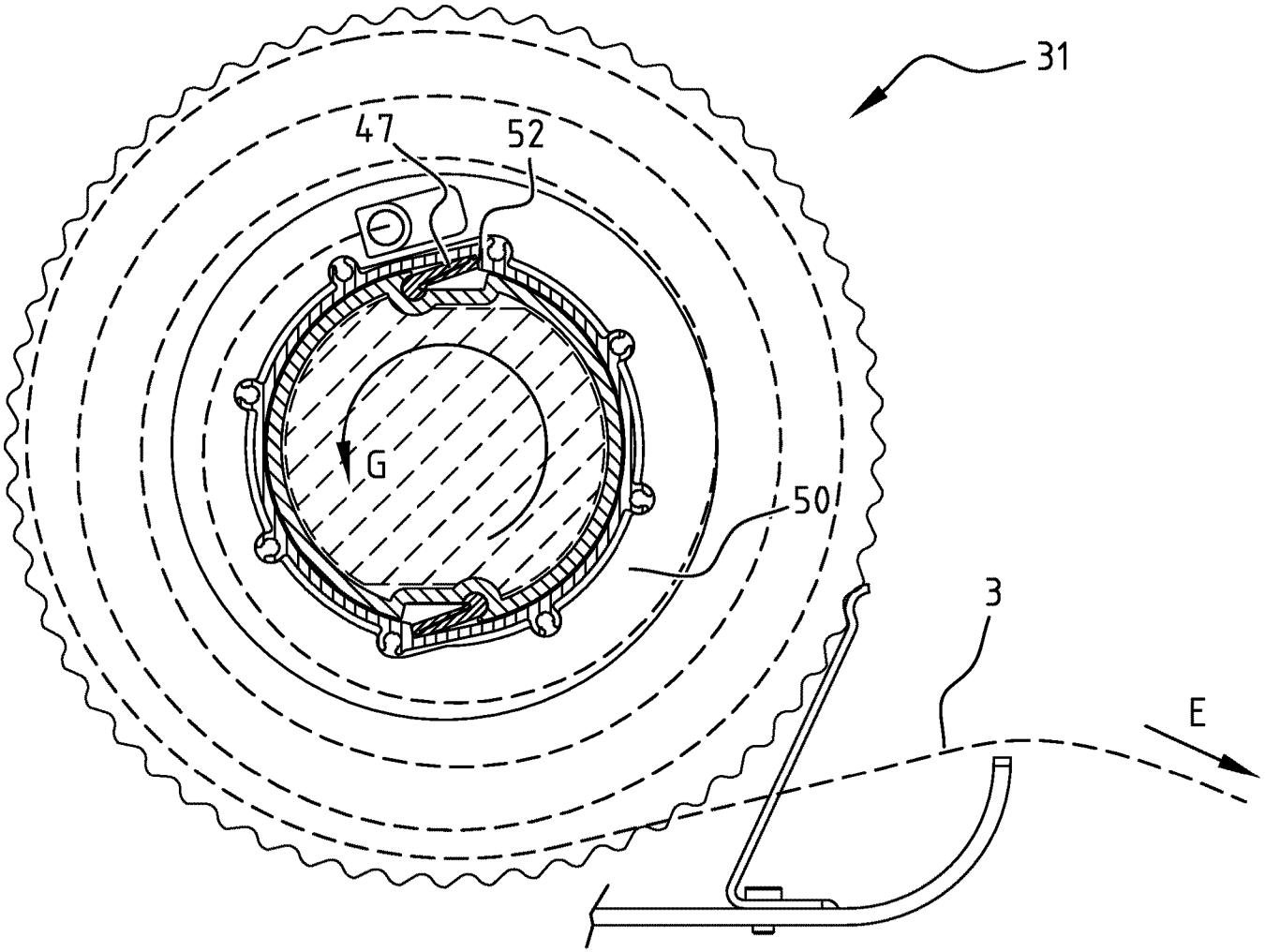
Figure 14:
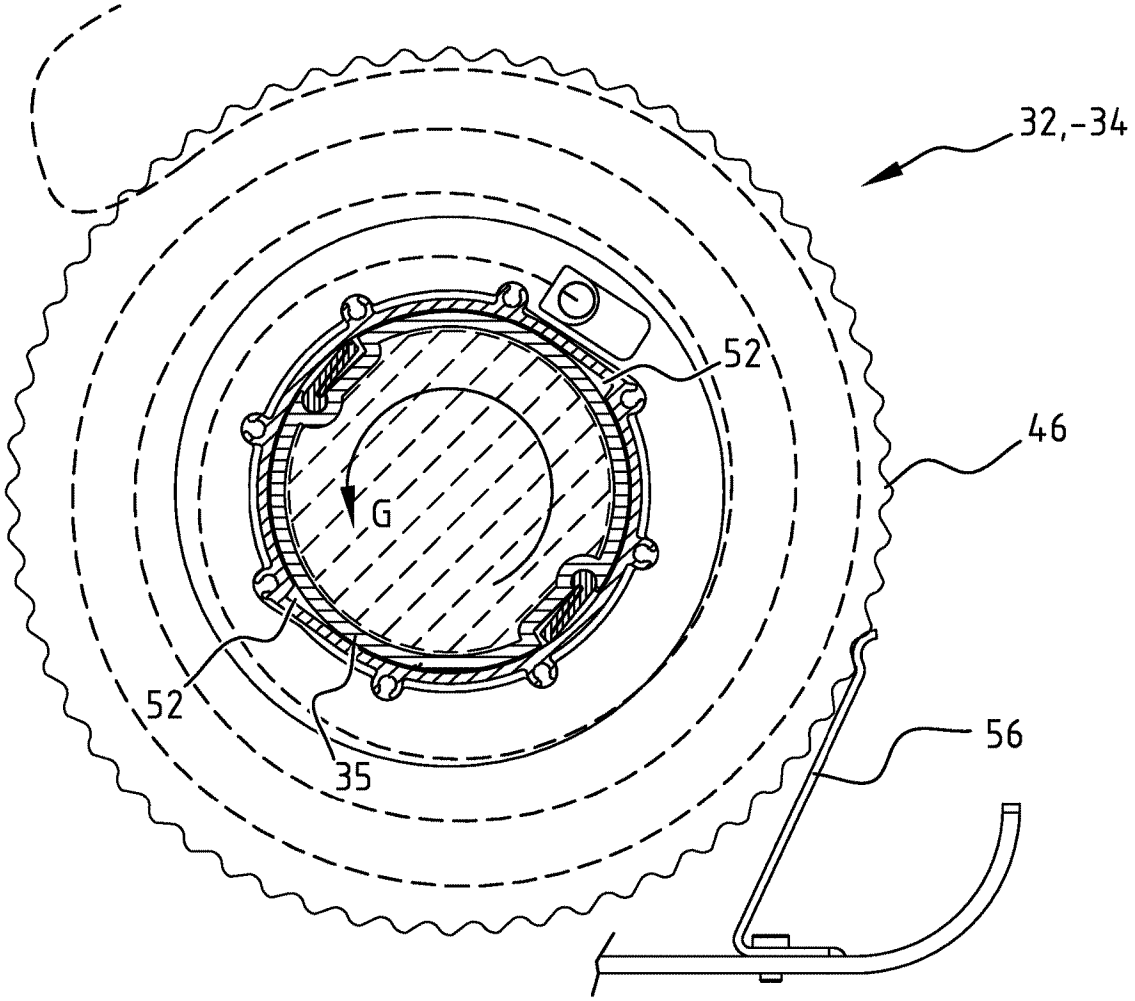
FIG. 14 represents a cross sectional side view of the embodiment in FIGS. 9-11 in another operational state.

The toothed wheel 44 of transmission 43 comprises or is connected with an insert 54, of which the circumferential shape corresponds closely with the internal surface of the transmission axis 35. In an assembled state, as shown in FIGS. 12, 13 and 14, the drum 31 is arranged on the transmission axis 35, which is in turn arranged on the insert 54 of the tooth wheel 44. When the drum 31 rotates to unwind cable therefrom, transmission 43 increases the rotational speed of the transmission axis 35 using the large toothed wheel 44 and the relatively small toothed wheel 45. Toothed wheel 45 is fixed to a drive axis 55 which extends into the rotation regulator 7. As shown in FIGS. 12, 13 and 14, the initial state is exhibited in FIG. 12, where the cable 3 has begun to unwind from the drum 31 in the direction of arrow E. This means, that an individual has coupled himself to an end of cable 3, and has started his or her descent from a higher level of the tall structure in a downward direction. From this initial state, the drum 31 is free to rotate around the transmission axis 35 over an angular distance indicated by arrow F. In this movement, there is no coupling between drum 31 and transmission axis 35 since coupling elements 47, that form extendable arms in the sense of the claims of the present disclosure, are maintained within the recesses 58. After drum 31 has freely rotated over an angular distance corresponding with arrow F outside of transmission axis 35, recesses 52 of the cylindrical body 49 will be positioned immediately above the coupling elements 47 within recesses 58 of the transmission axis 35. This state is shown in FIG. 13. The coupling elements 47, which tend to rotate in the direction of arrow D in FIG. 11, have room for this movement in an outward direction relative to the transmission axis 35, when the recesses 52 of the cylindrical body 49 of the drum 31 are arranged immediately above the recesses 58 in the transmission axis. The coupling elements 47 then come to abut within the recesses 52 of the cylindrical body 49, as a consequence of which a coupling is generated between the drum 31 and the transmission axis 35, when the drum 31 is rotated further in the counterclockwise direction corresponding with arrow F in FIG. 12. Since the transmission axis 35 is further coupled with insert 54, as shown in FIGS. 10, 12, 13 and 14, a rotational velocity is transmitted to the rotation regulator 7 via the transmission 43. As soon as the rotational speed in the direction of arrow G in FIG. 13 exceeds a limit, which is predetermined in the interior of the rotation regulator, for instance in the embodiment as described in relation to FIGS. 1-4, a rate of descent may be limited or restricted for a person hanging from the cable 3.

It should be noted, that when transmission axis 35 rotates in the direction of arrow G, as shown in FIG. 14, the other drums 32-34 may stand still, unless another individual is hanging from a cable 3 wound at least partially still on one of these other drums 32-34. To achieve this standstill of the other drums 32-34, a stop 56 is pressed against a toothed wheel 45. This is a very simple and elegant configuration, where hardly any force or pressure is required to maintain the standstill of the other drums 32-34. Namely, the coupling elements 47 in the recesses 58 of the transmission axis 35 will be dragged across the recesses 52 in the inner surface of the cylindrical body 49 of the other still standing drums 32-34, without achieving engagement or coupling there between.

Consequently, drum 31-34 only drives the transmission axis, when sufficient weight is suspended from a cable 3 which is wound around a relevant one of said drums 31-34. Still standing drums remain to be motionless, since no engagement is achieved between the coupling elements 47 and recesses 52.

It should be noted here, that many additional or alternative or combined embodiments are possible and will force themselves on the skilled person after having taken notice of the present disclosure, where such additional, alternative or combined embodiments are intended to the incompetence within the scope of protection according to the definitions of the appended claims, unless such embodiments comprise components, elements or aspects that differ substantively from the definitions of the scope of protection according to the appended claims. For instance, relative to the embodiments of FIGS. 8-14, just two, three or more than four drums can be provided. Each of the drums may have an individual rotation regulator instead of the common rotation regulator of the above described embodiments. FIGS. 8 and 9 only mutually differ with respect to the presence of the crankshaft in combination with the crank, but are for the rest considered essentially identical. Other brake systems or speed reduction systems can be envisaged, in addition to or as alternatives for the rotation regulators 7 in the embodiments. The sleeve 22 in FIGS. 6 and 7 can have any suitable shape or form, such as tubular, and can be made from any suitable material, but is preferably provided in an embodiment of a smooth, low friction material. The transmission 43 can connect anyone of the drums 31-34 with the rotation regulator 7, where coupling elements 47 and recesses 52 act and function as switches and/or selectors to couple a used one of the drums 31-34 with the transmission axis 35. In this sense, these coupling elements in combination with the recesses can be considered to constitute switches and/or selectors. However, in another embodiment it may be possible to require an operator to actively set a switch or selector to engage a selected one or more than one of the drums 31-34 with the transmission axis 35. Further, it may be possible to prevent, in an embodiment with a lot of drums 31-34, to limit the force exerted on the rotation regulator, by preventing too many of the drums 31-34 from being connected simultaneously to the rotation regulator 7. For instance, selectors and/or switches can be interconnected to prevent more than two of the drums 31-34 from being connected to the rotation regulator 7. In relation to FIG. 8 it has been disclosed that a manual crank or crankshaft can be provided to draw a cable back on its drum. However, it is also very well possible to provide an automated manner, employing for instance a motor or the like, of retrieving a cable and rewinding it onto its drum. However, any embodiment should preferably be independently powered from the structure, to which such a device is attached, in view of the potential danger of power falling out during for instance a fire.

We claim:

1. A device for evacuating individuals from a structure during an emergency, comprising:

a rotatable drum with a cable of suitable length, wound thereon; and a rotation regulator, which is associated with the rotatable drum and is arranged to control the rotatable drum to limit a rotation speed thereof during unwinding of the cable from the rotatable drum; and at least one additional drum with an additional cable wound thereon;

characterized by a selector or a switch arranged to selectively connect at least one of the rotatable drum and the additional drum with the rotation regulator.

2. The device of claim 1, further comprising:

a transmission, which is provided between at least the rotatable drum and the rotation regulator and is arranged to selectively connect at least the rotatable drum with the rotation regulator.

3. The device of claim 1, wherein the transmission comprises the switch or selector, or vice versa.

4. The device of claim 1, further comprising a guide sleeve in use to be arranged on the cable at a fixed distance from the device.

5. The device of claim 4, wherein the guide sleeve is attached to a flexible retainer.

6. The device according to claim 1, wherein the rotation regulator comprises a swivel brake shoe, which is connected or connectable to at least the rotatable drum to rotate at a rotational speed corresponding with that of the rotatable drum during unwinding of the cable, and arranged to swivel relative to a rest position, when rotational speed of the rotatable drum approaches and/or exceeds a predetermined threshold.

7. The device of claim 6, wherein the swivel brake shoe comprises a flexible restrainer, arranged to restrain the swivel brake shoe from swiveling at a rotation speed of the rotatable drum below the predetermined threshold of the rotational speed of the rotatable drum.

8. The device of claim 7, wherein the rotational regulator comprises two or more brake shoes connected by a spring mechanism to a rotational axis of the rotational regulator or each other in an at least approximately symmetrical manner.

9. The device of claim 1, wherein the device comprises an attachment to fix the device to the structure.

10. The device of claim 1, comprising a crank mechanism for winding the cable about the rotatable drum.

11. The device of claim 1, wherein the rotation regulator has a central axis offset from, and parallel to, an axis of rotation of the rotatable drum.

12. A device for evacuating individuals from a structure during an emergency, comprising:

a rotatable drum with a cable of suitable length, wound thereon; and a rotation regulator, which is associated with the rotatable drum and is arranged to control the rotatable drum to limit a rotation speed thereof during unwinding of the cable from the rotatable drum; and at least one additional drum;

characterized by a selector or a switch arranged to selectively connect at least one of the rotatable drum and the additional drum with the rotation regulator;

wherein at least the rotatable drum is accommodated on a transmission axis, wherein the transmission axis is rotatable within at least the rotatable drum, and comprises an assembly of an extendable arm and a recess, wherein the recess is shaped and designed to accommodate the arm in a predetermined rotational position of the transmission axis relative to the rotatable drum.

13. The device of claim 12, wherein the arm is accommodated in or on the axis and the recess is arranged in the rotatable drum, or vice versa.

14. The device of claim 12, wherein the transmission axis is connected to the rotation regulator, via transmission, which transmission is arranged to increase the rotational speed of the axis for the rotation regulator.

15. The device of claim 12, wherein the rotation regulator has a central axis offset from, and parallel to, an axis of rotation of the rotatable drum.

16. A method for safely evacuating individuals from a structure during an emergency comprising:

(a) providing a device including a rotatable drum with a cable of suitable length, wound thereon, and a rotation regulator, which is associated with the rotatable drum and is arranged to control the rotatable drum to limit a rotation speed thereof during unwinding of the cable from the rotatable drum, and at least one additional drum with an additional cable wound thereon;

(b) attaching at least one first individual to the device;

(c) lowering the at least one first individual to a safe level using the device;

(d) rewinding the cable about the rotatable drum;

€ optionally, repeating steps (c) to (d); and characterized by the step of subsequent or simultaneous lowering of more than one of the individuals prior to rewinding at least one cable with the device, wherein a selector or a switch selectively connects at least one of the rotatable drum and then additional drum with the rotation regulator.

17. The method of claim 16, wherein the rotation regulator has a central axis offset from, and parallel to, an axis of rotation of the rotatable drum.

* * * * *